US005692617A

United States Patent [19]

Adams

[11] Patent Number: 5,692,617

[45] Date of Patent: Dec. 2, 1997

[54] CONTAINER STORAGE SYSTEM

[76] Inventor: Kathleen Adams, 3550 Marlesta Dr., San Diego, Calif. 92111

[21] Appl. No.: 587,456

[22] Filed: Jan. 11, 1996

[51] Int. Cl.[6] ..... B65D 21/036

[52] U.S. Cl. ..... 206/508; 206/501; 206/515; 220/212; 220/380

[58] Field of Search ..... 220/212, 380; 206/501, 515, 508

[56] References Cited

U.S. PATENT DOCUMENTS

| | | | |
|---|---|---|---|
| 2,412,325 | 12/1946 | Devine et al. . | |
| 2,564,834 | 8/1951 | Devine et al. . | |
| 3,815,736 | 6/1974 | Sedlak . | |
| 3,954,178 | 5/1976 | Mason, Jr. | 206/508 |
| 4,166,548 | 9/1979 | Crisci . | |
| 4,874,103 | 10/1989 | Quisenberry et al. . | |
| 4,951,832 | 8/1990 | Tenney et al. . | |
| 5,150,804 | 9/1992 | Blanchet | 220/380 |
| 5,184,745 | 2/1993 | Havens et al. . | |
| 5,253,758 | 10/1993 | Bissell, II | 220/212 |
| 5,253,781 | 10/1993 | Van Melle et al. | 220/390 |
| 5,474,184 | 12/1995 | Mandler et al. | 206/508 |

*Primary Examiner*—Stephen J. Castellano
*Attorney, Agent, or Firm*—Nydegger & Associates

[57] ABSTRACT

The present invention is a storable system of containers. Structurally, the present invention includes a series of vessels and corresponding covers. Each vessel is partially insertable into another vessel to configure the vessels as a vessel stack. Each cover is attachable to another cover to configure the covers as a cover stack. The cover stack and vessel stack are attachable to form a storage stack. An individual container is removable from the storage stack by removing a single vessel and the corresponding cover.

9 Claims, 3 Drawing Sheets

CONTAINER STORAGE SYSTEM

FIELD OF THE INVENTION

The present invention pertains generally to devices which are useful for the storage of goods. More particularly, the present invention pertains to storage systems and the storage of storage systems. The present invention is particularly, but not exclusively, useful as system of covers and vessels that can be stored in an organized fashion.

BACKGROUND OF THE INVENTION

The use of storage containers is well known. In fact, the use of various reusable containers in the home and workplace is commonplace to the point of ubiquity. Many of these containers take the form of plastic vessels that function in combination with a corresponding cover. The cover attaches to the vessel, sealing the vessel and enclosing whatever may be inside. The vessels and covers are available in a large variety of shapes and sizes allowing differing containers to be utilized to store an endless array of differing objects.

Although reusable containers have been found to be highly convenient devices for the storage of goods, storage of the containers themselves has proven to be more problematic. More specifically, it is often the case that a large number of containers will be stored in random fashion in a single area and that the storage will resemble a more-or-less disorganized array of vessels and covers. When it becomes necessary to use a specific container, a search will generally have to be made to locate a compatible vessel and cover. The difficulty and inconvenience involved in a search of this type increases, of course, with the number of vessels and covers involved.

Several methods have been developed to avoid the inconvenience associated with unorganized storage of vessels and containers. For example, U.S. Pat. No. 2,412,325 which issued to Devine et al. for an invention entitled "Receptacle and Cover Therefor" discloses a system of covers and vessels. The vessels are shaped to allow stacking of the vessels. Similarly, the covers are shaped to allow stacking of the covers. The stack of covers and the stack of vessels provide a relatively convenient method for storage of the containers in a relatively organized fashion.

Another method for storing a system of containers is disclosed in U.S. Pat. No. 4,951,832 which issued to Tenney et al. for an invention entitled "Multi-Functional Space Saving Container System." The system disclosed by Tenney et al., includes a set of vessels and a set of matching covers. The cover for each vessel may be attached to seal the vessel. Alternately, the cover may be attached to the bottom of the vessel for storage of the container system. During storage, each cover is attached to the bottom of the corresponding vessel and the combined vessels and covers are nested together to form a single storage unit. Like the system of Divine et al., the system of Tenney et al. provides a relatively convenient method for storage of containers in a relatively organized fashion.

The present invention recognizes that, in spite of the previously described inventions, there still exists a need for improved systems of storable container systems. In particular, the present invention recognizes that it is desirable to produce container systems that facilitate easy storage and easy retrieval of single containers from the stored system. The present invention also recognizes that there exists a need for a container systems that may be stored in a organized fashion and that has a tendency to remain organized in spite of the everyday jostling which may be present in the storage environment.

In light of the above, it is an object of the present invention to provide a container system which is easily storable. Another object of the present invention is to provide a storable container system which allows single containers to be easily removed from storage. Still another object of the present invention is to provide a storable container system which tends to remain organized during storage. Yet another object of the present invention is to provide a storable container which is simple to use, relatively easy to manufacture and comparatively cost effective.

SUMMARY OF THE PREFERRED EMBODIMENTS

The present invention is a storable system of containers. In general terms, the present invention includes a series of containers, with each container including a vessel and a corresponding cover. Each vessel and each container are generally formed from a somewhat flexible and somewhat resilient material, such as many plastic types.

Each vessel has a base formed to surround a cavity. Each vessel also has an open top through which the cavity may be accessed. Each vessel is partially insertable into other similar vessels by partially inserting the base of the vessel into the open top of the similar vessel. In this fashion, the series of vessels may be configured as a sequential stack of vessels, or vessel stack. For purposes of illustration it is assumed that the vessel stack include one vessel having an exposed base and one vessel having an exposed top.

Each base of each vessel includes a connector which is positioned to be axially opposite the vessel's open top. For the purposes of the present invention many differing connector types may be used. Preferably, however, the connector included in the base of each vessel is formed as a female snap-type connector and is formed to be substantially flush with the base of the vessel. Importantly, the connector included in the vessel having an exposed base is exposed, allowing the exposed connector to serve as a point of attachment.

Each of the covers is substantially flat and has a first side and a second side with the first side being selectively attachable to cover the open top of the correspond vessel. The first side of each cover includes a first connector and the second side of each cover includes a second connector. Preferably, the first connector is configured as a female snap-type connector and the second connector is configured as a compatible male snap-type connector. The first and second connectors of each cover are interconnectable allowing the series of covers to be configured as a sequential stack of covers, or cover stack. The cover stack includes one cover having an exposed first side and an exposed first connector. The cover stack also includes one cover having an exposed second side and an exposed second connector.

The second connector included in each of the covers is also compatible with the connector included in the base of each vessel. In this way, each cover may be attached to the base of the associated vessel. More importantly, however, by interconnecting the exposed connector included in the vessel stack with the exposed second connector included in the cover stack, the vessel stack and cover stack may be configured as a single storage stack. Single containers may then be removed from the storage stack by removing the vessel having and exposed top and the matching cover having an exposed first side.

For an alternate embodiment of the present invention, the connector included in the base of each vessel is omitted. In cases where no connector is included in the base of the vessels, the vessel stack and cover stack are interconnected by attaching the cover having an exposed first side to the vessel having an exposed top as if the cover having an exposed first side were being used to seal the vessel having an exposed top. Single containers may then be removed from the storage stack thus formed by removing the vessel having an exposed base and the matching cover having an exposed second side.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
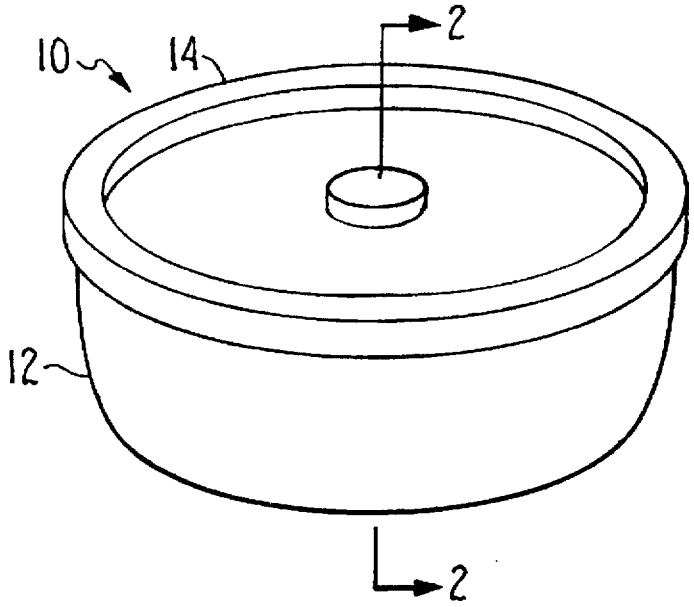
FIG. 1 is an isometric view of the vessel and cover of the present invention.

The present invention is a storable system of containers. Referring initially to FIG. 1, an exemplary container is shown and generally designated 10. In general terms, it may be seen that the container 10 of the present invention includes a vessel 12 and a cover 14. Both the vessel 12 and the cover 14 are formed from a somewhat flexible and somewhat resilient material, such as plastic. Additionally, in many cases, the particular plastic used to form the vessel 12 or top 14 will be transparent or translucent.

Figure 2:
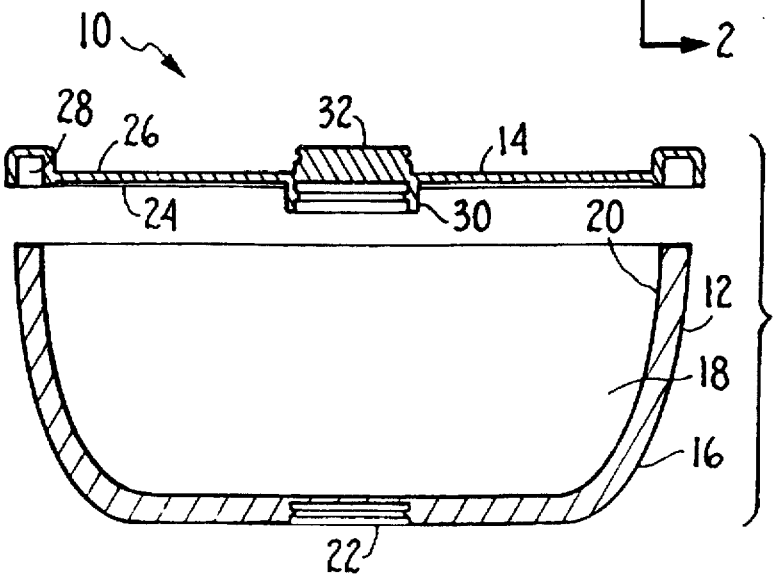
FIG. 2 is a cross-sectional view of the vessel and cover of the present invention taken along the lines 2—2 in FIG. 1.
Figure 3:
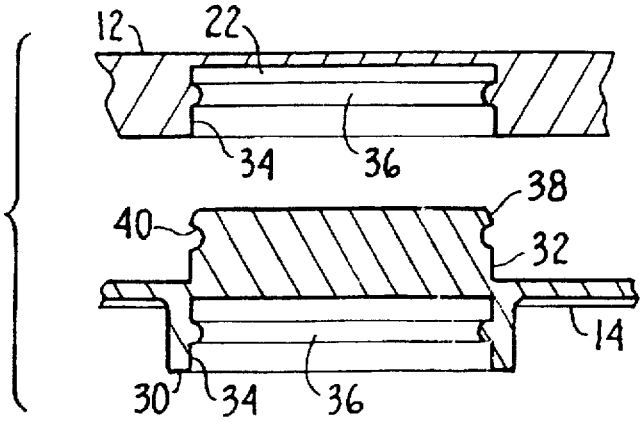
FIG. 3 is a cross-sectional view of the vessels and covers of the present invention as seen along the line 2—2 in FIG. 1, with a plurality of the vessels and covers shown configured as a storage stack.

The structural details of the container 10 of the present invention are better appreciated by reference to FIG. 2 where it may be seen that the vessel 12 includes a base 16 formed to surround a cavity 18 having an open top 20. Each vessel 12 also includes a connector 22. The connector 22 is positioned to be axially opposite the open top 20. In general, the connector 22 may be selected from a wide range of differing connector types. Preferably, however, the connector 22 is a female snap-type connector and is fabricated to be substantially flush with the base 16 of the vessel 12. Alternatively stated, connector 22 is formed to not protrude from base 16 of vessel 12. In this fashion, connector 22 does not interfere with positioning vessel 12 on flat or other surfaces.

The cover 14 of the present invention is formed to be substantially flat and has a first side 24 and a second side 26. The first side 24 of the cover 14 includes an annular groove 28. The annular groove 28 is dimensioned to allow the first side 24 of the cover 14 to be sealingly connected to the vessel 12. The cover 14 also includes a first connector 30 attached to the first side 24 and a second connector 32 attached to the second side 26. The first connector 30, like the connector 22, is preferably fabricated as a female snap-type connector. Additionally, the second connector 32 is preferably fabricated as a male snap-type connector. For the purposes of the present invention, the second connector 32 is chosen to be interconnectable with the connector 22 of the vessel 12 and interconnectable with the first connector 30.

Figure 4:
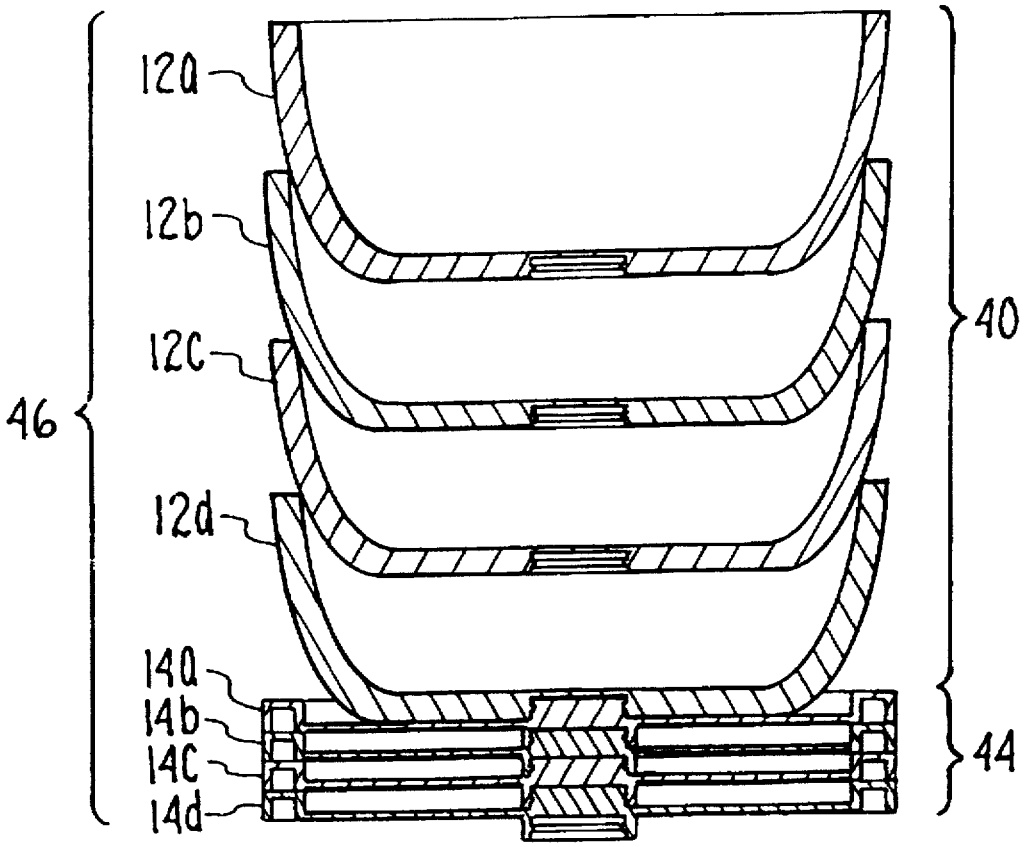
FIG. 4 is a cross-sectional detail of the connectors of the present invention.

The structural details of connector 22, first connector 30 and second connector 32 are better appreciated by reference to FIG. 4. In FIG. 4, it may be seen that connector 22 and first connector 30 are fabricated as female snap-type connectors. Both connector 22 and first connector 30 are formed to include a barrel 34 having an annular detent 36. Second connector 32, includes a protrusion 38, formed to include an annular ring 40. Protrusion 38 is dimensioned to be insertable into the barrel 34 of first connector 30. Protrusion 38 is also dimensioned to be insertable into the barrel 34 of connector 22. When fully inserted, the annular ring 40 of second connector 32 snaps into the annular detent of first connector 30 or second connector 22, holding the respective connectors firmly together. Importantly, first connector 30, second connector 32 and connector 22 are chosen to have a standard type and size. In this fashion, the second connector 32 of any particular cover 14 is interconnectable with the connector 22 of any vessel 12 and interconnectable with the first connector 30 of any cover 14.

The cooperation between the vessels 12 and the covers 14 is better appreciated by reference to FIG. 4. In FIG. 4, it may be seen that each vessel 12 is partially insertable into another vessel 12. For example, in FIG. 4, it may be seen that vessel **12*a* is partially inserted into vessel 12*b*. Vessel 12*b* is, in turn, partially inserted into vessel 12*c* and vessel 12*c* is partially inserted into vessel 12*d*. In this way, the vessels 12 may be configured as a sequential stack of vessels, or vessel stack 42. Within vessel stack 42, it may be seen that vessel 12*d* is positioned to be the lowermost vessel 12. As a result, vessel 12*d* has a base 36 and a connector 22 which are exposed, or not contained within another vessel 12. Additionally, it may be seen that vessel 12*a* is positioned to be the uppermost vessel 12 in the vessel stack 42. As a result, the open top 20 of vessel 12*a* is exposed, or not obscured by another vessel 12**.

Continuing with FIG. 4, it may be seen that the first connector 30 of each cover 14 is connectable to the second connector 32 of a subsequent cover 14. For example, first connector 30 of cover **14*a* is connected to the second connector 32 of cover 14*b*. In turn, first connector 30 of cover 14*b* is connected to the second connector 32 of cover 14*c* and first connector 30 of cover 14*c* is connected to the second connector 32 of cover 14*d*. In this fashion, covers 14 are configurable into a sequential stack of covers 14, or cover stack 44. Within cover stack 44, it may be seen that cover 14*d* is positioned to be the lowermost cover 14. As a result, cover 14*d* has a first side 24 and a first connector 30 which are exposed, or not connected to another cover 14. Additionally, it may be seen that cover 14*a* is positioned to be the uppermost cover 14 in the cover stack 44. As a result, the second side 26 and second connector 32 of cover 14*a* are exposed, or not connected to another cover 14**.

Importantly, the exposed second connector 32 of the uppermost cover **14*a* is connected to the exposed connector 22 of the lowermost vessel 12. In this fashion, the vessel stack 42 and cover stack 44 are interconnected to form a storage stack 46. The storage stack 46 may be stored in any convenient location. The storage stack 46 may also be stored in any orientation and tends to remain organized when bumped or jostled. A single container 10 may be removed from the storage stack 46 by removing the uppermost vessel 12***a* and lowermost cover 12*d* from the storage stack 46.

Figure 5:
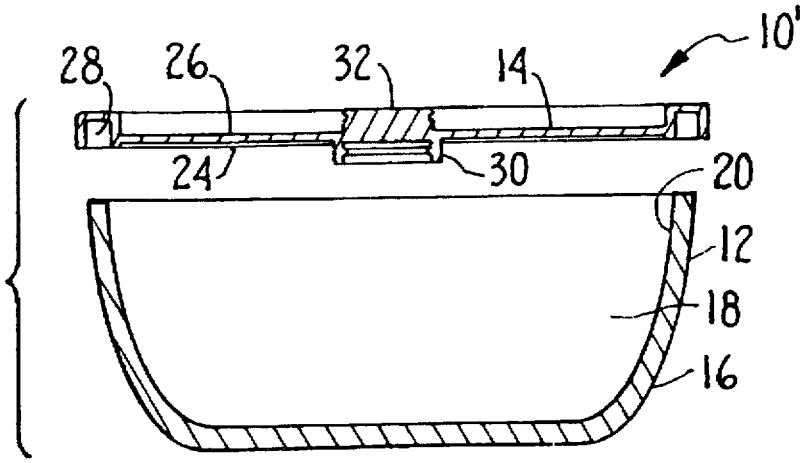
FIG. 5 is a cross-sectional view of an alternate embodiment of the vessel and cover of the present invention taken along a line corresponding to line 2—2 in FIG. 1.
Figure 6:
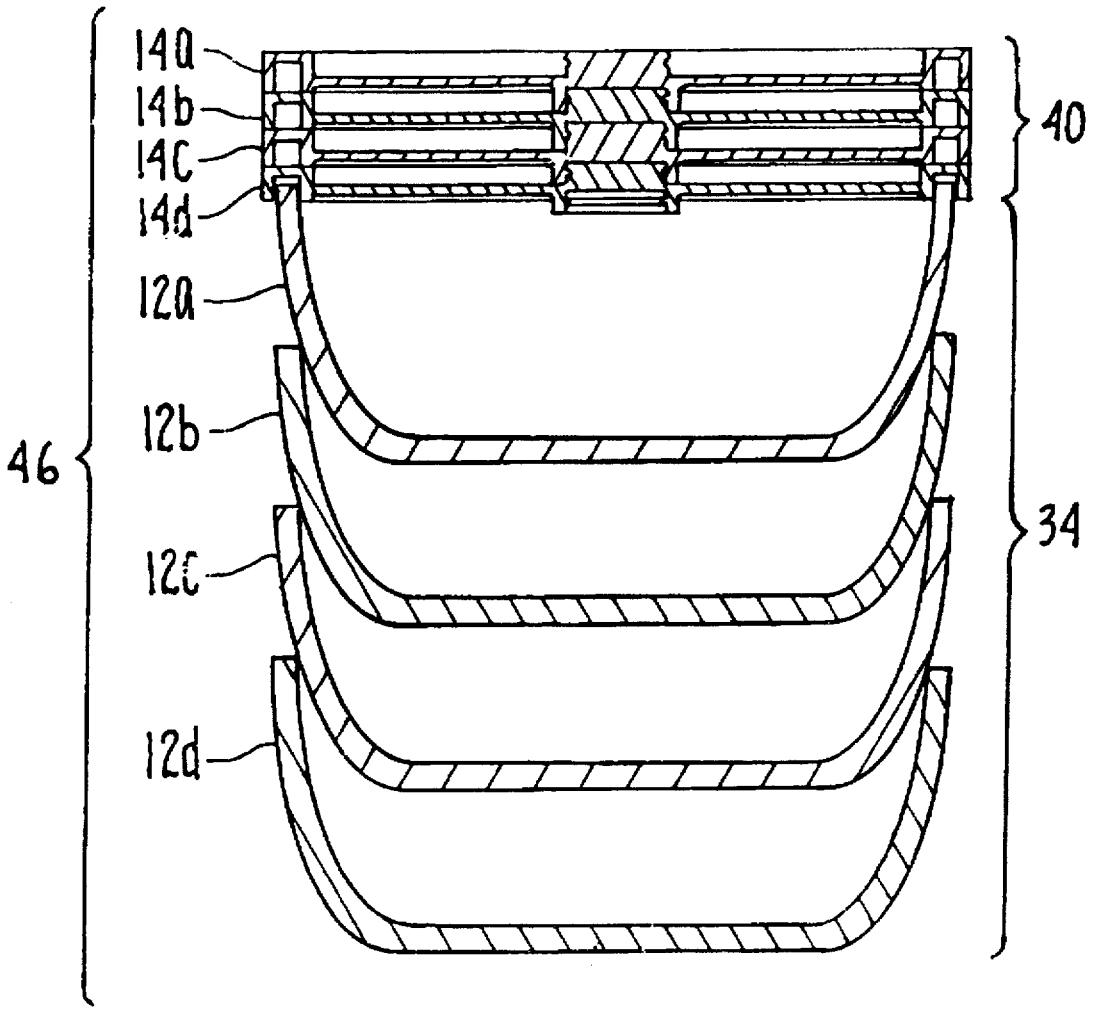
FIG. 6 is a cross-sectional view of an alternate embodiment for the vessels of the present invention, as would be seen along a line corresponding to line 2—2 in FIG. 1, with a plurality of the vessels shown configured with the covers of the present invention as a storage stack.

Referring now to FIG. 5, an alternate embodiment for the container 10 of FIGS. 1 through 4 is shown and generally designated 10' The container 10' of FIG. 5 generally resembles the container 10 of FIGS. 1 through 4. In the case container 10', however, the connector 22 is omitted from each of the vessels 12. Turning now to FIG. 5 it may be seen that the container 10' of FIG. 4 may be configured into a storage stack 46 without the use of connector 22. In more detail, it may be seen that the exposed first side 24 of the lowermost cover 14*d* is connected to the exposed open top 20 of the uppermost vessel 12*a*. In this fashion, the vessel stack 42 of FIG. 6 is interconnected to the cover stack 44 to form storage stack 46 without the use of connector 22. Single containers may be removed from the storage stack 46 of FIG. 6 by removing the lowermost vessel 12*d* and the uppermost cover 14*a*.

While the particular container storage system as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. A system of storable containers which comprises:

a plurality of vessels, each said vessel having a base formed to surround a cavity having an open top, each said vessel partially insertable into said cavity of another said vessel to configure said vessels as a sequential vessel stack, said vessel stack including one vessel having an exposed top and one vessel having an exposed base;

a plurality of covers, each said cover having a first side and a second side, each said first side of said cover attachable to a corresponding vessel to enclose said cavity of said vessel;

means for attaching said first side of each said cover to said second side of another said cover, including a plurality of first fasteners and a plurality of second fasteners, one said first fastener attached to said first side of each said cover, one said second fastener attached to said second side of each said cover, said covers configurable as a stack of covers by positioning said covers in a sequence and interconnecting each adjacent first fastener and second fastener, said cover stack including one cover having an exposed first side and one cover having an exposed second side; and means for attaching said vessel stack to said cover stack, including a plurality of third fasteners, one said third fastener attached to said base of each said vessel, said vessel stack attachable to said cover stack by interconnecting said second connector of said cover having an exposed second side to said third connector of said vessel having exposed base, wherein said third connector of said vessels and said second connector of said covers are compatible snap-together fasteners to configure said vessel stack and said cover stack as a storage stack, single containers removable from said storage stack by removing one said vessel and one said cover from said storage stack.

2. A system of storable containers as recited in claim 1 wherein said first side of each cover includes an annular seal for attaching said first side of said cover to one said vessel to enclose said cavity.

3. A system of storable containers as recited in claim 1 wherein said first connector of said covers and said second connector of said covers are compatible snap-together fasteners.

4. A system of storable containers which comprises:

a plurality of vessels, each said vessel including a base formed to surround a cavity having an open top, each said base also having a connector, said connector positioned axially opposite said open top of said cavity, each said vessel partially insertable into said open top of another said vessel to configure said vessels as a sequential vessel stack, said vessel stack including one vessel having an exposed connector; and a plurality of covers, each said cover attachable to a corresponding vessel to enclose said cavity, each said cover formed with a first connector and a second connector, said first connector of each cover attachable to said second connector of another cover to configure said covers as a sequential cover stack, said cover stack including one cover having an exposed second connector and wherein said connector of said vessels and said first connector of said covers are compatible snap-together fasteners.

5. A system of storable containers as recited in claim 4 wherein each said cover includes an annular seal for attaching said cover to one said vessel to enclose said cavity.

6. A system of storable containers as recited in claim 4 wherein said first connector of said covers and said second connector of said covers are compatible snap-together fasteners.

7. A system of storable containers as recited in claim 6 wherein said connector of each said vessel is formed to be substantially flush with said base of said vessel.

8. A system of storable containers as recited in claim 4 wherein said vessel stack is connectable to said cover stack to form a storage stack.

9. A system of storable containers as recited in claim 8 wherein said vessel stack is connectable to said cover stack to form a storage stack by interconnecting said first connector of said cover stack with said exposed connector for said vessel stack.

* * * * *